US006427589B2

(12) United States Patent
Watanabe

(10) Patent No.: US 6,427,589 B2
(45) Date of Patent: Aug. 6, 2002

(54) STENCIL PRINTER AND INFORMATION STORAGE MEDIUM STORING THEREIN SOFTWARE FOR CONTROLLING THE STENCIL PRINTER

(75) Inventor: Hidetoshi Watanabe, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 10 days.

(21) Appl. No.: 09/742,238

(22) Filed: Dec. 22, 2000

(30) Foreign Application Priority Data

Dec. 28, 1999 (JP) ..... 11-374363

(51) Int. Cl.[7] ..... B41C 1/14
(52) U.S. Cl. ..... 101/128.4; 101/114
(58) Field of Search ..... 101/114, 127, 101/128.4, 48, 116; 400/70, 74

(56) References Cited

U.S. PATENT DOCUMENTS

| | | | | |
|---|---|---|---|---|
| 6,070,525 A | * | 6/2000 | Watanabe et al. | 101/129 |
| 6,161,476 A | * | 12/2000 | Yoneoka | 101/118 |
| 6,295,924 B1 | * | 10/2001 | Nishihata et al. | 101/116 |
| 6,330,012 B1 | * | 12/2001 | Irie | 347/195 |
| 6,334,719 B1 | * | 1/2002 | Kimura | 400/54 |

FOREIGN PATENT DOCUMENTS

| | | |
|---|---|---|
| EP | 0 653 308 | 5/1995 |
| EP | 0 827 106 | 3/1998 |
| EP | 0 930 561 | 7/1999 |

* cited by examiner

*Primary Examiner*—Andrew H. Hirshfeld
*Assistant Examiner*—Darius N. Cone
(74) *Attorney, Agent, or Firm*—Nixon Peabody LLP; Donald R. Studebaker

(57) ABSTRACT

A stencil printer includes a stencil making system which makes a stencil by imagewise perforating a stencil material in a controlled position on the basis of an image signal, a printing system which makes prints by the use of the stencil made by the stencil making system and a control system which controls the stencil making system and the printing system. The control system is provided with a first stencil making position controller adapted to control of the stencil making position when a stencil is to be made on the basis of an internal image signal optically read out from an original, a second stencil making position controller adapted to control of the stencil making position when a stencil is to be made on the basis of an external image signal input through a path different from the path along which the internal image signal is input, and a selector which selectively makes active one of the first and second stencil making position controllers.

7 Claims, 9 Drawing Sheets

STENCIL PRINTER AND INFORMATION STORAGE MEDIUM STORING THEREIN SOFTWARE FOR CONTROLLING THE STENCIL PRINTER

BACKGROUND OF THE INVENTION

1. Field of the Invention

This invention relates to a stencil printer and an information storage medium, and more particularly to a stencil printer provided with a stencil making position adjusting means for adjusting the stencil making position and an information storage medium in which software for controlling the stencil printer in adjusting the stencil making position is stored.

2. Description of the Related Art

Recently, a stencil printer is required to make a stencil on the basis of not only an image signal read out from an original by an image scanner but also an image signal input from an external apparatus such as a personal computer. That is, as the image processing performance of a general-purpose computer such as a personal computer becomes better and as the use of the personal computer spreads, the stencil printer comes to be required to make a stencil on the basis of an image signal input from a personal computer and to make prints by the use of the stencil.

However, in conventional stencil printers, adjustment of the stencil making position is possible when the stencil is made on the basis of an image signal input from an image scanner (will be referred to as "an internal image signal", hereinbelow) but impossible when the stencil is made on the basis of an image signal input from an external apparatus (will be referred to as "an external image signal", hereinbelow) This is because the conventional stencil printers are not provided with a means for adjusting the making position of a stencil which is made on the basis of an external image signal.

Generally the image scanner is not replaced often. Accordingly, the means for adjusting the stencil making position in the conventional stencil printer is provided for the purpose of compensating for error in the stencil making position caused by difference between properties of scanners and/or stencil making apparatuses and the mounting error of the scanner and/or the stencil making apparatus, and accordingly, is not generally operated after it is once adjusted so that a proper stencil making position is obtained taking into account matching of the scanner and the stencil making apparatus.

That is, in order to adjust the stencil making position when prints are made on the basis of an external image signal in the conventional stencil printers, it is necessary to once make a stencil on the basis of the external image signal, make a trial print by the use of the stencil and correct the external image signal on the basis of the trial print by processing the external image signal by the external personal computer or the like. This is repeated until a desired stencil making position is obtained.

Thus, when prints are to be made on the basis of an external image signal in the conventional stencil printers, the operator must move back and forth between the stencil printer and the personal computer to adjust the stencil making position, which is very troublesome and requires a long time. Further, since many stencils must be made and the stencil material is consumed in vain, the printing cost is increased.

Further, there have been known stencil printers in which the stencil making position can be adjusted when a stencil is to be made on the basis of an internal image signal (an image signal read out from an original by the image scanner) and those the printing position on the printing paper can be adjusted by changing the position of the printing paper relative to the stencil on the printing drum. In such stencil printers, the stencil making position and/or the printing position when prints are to be made by the use of a stencil made on the basis of an external image signal can be adjusted by the use of means for adjusting the stencil making position and/or the means for adjusting the printing position when prints are to be made on the basis of the internal image signal.

However when the conventional means for adjusting the stencil making position and/or the printing position for the internal image signal are used for adjusting the stencil making position and/or the printing position for the external image signal, there arises a problem that the operator can confuse setting of the stencil making position (and printing position) for an external image signal with setting of the stencil making position (and printing position) for an internal image signal, which can result in deterioration in controllability for controlling the stencil making position and/or the printing position to a correct position.

Further, such confusion of the stencil making position setting can result-in a situation where a desired stencil making position cannot be obtained irrespective of the operator's intent to set the stencil making position to a correct position and the stencil must be repeatedly remade, which deteriorates printing throughput and adds to printing cost, whereby properties of the stencil printer that a middle to large amount of copies can be obtained in a short time at low cost cannot be sufficiently realized.

For example, when an operator adjusts the stencil making position and/or the printing position before making prints on the basis of an external image signal and then another operator makes prints on the basis of an internal image signal without recognizing that the stencil making position and/or the printing position has been set to conform to the external input mode (a mode in which prints are made on the basis of the external image signal), the stencil making position and/or the printing position deviates from the correct position, which results waste of the stencil material and/or the printing papers.

Especially since the stencil making cost including the material cost and the time cost shares a major part of the printing cost, it is greatly desired to suppress waste of the stencil material to lower the printing cost. Thus, overcoming the aforesaid problems involved by adjustment of the stencil making position is very important to prevent waste of the stencil material.

Further, though displacement of the printing position due to displacement of the stencil making position can be corrected by the use of the printing position adjustment function of a conventional stencil printer, the approach is only a temporary solution of the problem and not a basic solution. Further, when another operator uses the stencil printer without knowing that the printing position has been changed from the regular position, the printing position in the obtained copies can deviate from the regular position even if the stencil for the original is made in the correct position. Accordingly, it is necessary to control the stencil making position itself when prints are to be made on the basis of an external image signal.

Further, since the stencil printers are often used by unskilled users due to its inherency, the stencil printers are desired to be arranged so that the steps from the step of adjusting the stencil making position to the step of printing can be easily and correctly effected without confusion of the input modes and without causing a wrong operation of the printer due to the confusion of the input modes even if the stencil printer is used by an unskilled user.

SUMMARY OF THE INVENTION

In view of the foregoing observations and description, the primary object of the present invention is to provide a stencil printer in which stencil making position adjustment for adjusting the stencil making position for a stencil to be made on the basis of an internal image signal and that for adjusting the stencil making position for a stencil to be made on the basis of an external image signal can be effected clearly separated from each other without confusion and as a result, waste of the stencil material and the printing paper can be suppressed, whereby the aforesaid properties inherent to the stencil printer that a middle to large amount of copies can be obtained in a short time at low cost can be sufficiently realized.

Another object of the present invention is to provide an information storage medium in which software for controlling the stencil printer so that the aforesaid primary object is accomplished is stored.

In accordance with a first aspect of the present invention, there is provided a stencil printer comprising a stencil making means which makes a stencil by imagewise perforating a stencil material in a controlled position thereon on the basis of an image signal, a printing means which makes prints by the use of the stencil made by the stencil making means and a control means which controls the stencil making means and the printing means, wherein the improvement comprises that the control means is provided with a first stencil making position control means adapted to control of the stencil making position when a stencil is to be made on the basis of an internal image signal optically read out from an original, a second stencil making position control means adapted to control of the stencil making position when a stencil is to be made on the basis of an external image signal input through a path different from the path along which the internal image signal is input, and a selector means which selectively makes active one of the first and second stencil making position control means.

The selector means may be manually operated to make active one of the first and second stencil making position control means or may be automatically operated to make active one of the first and second stencil making position control means according to whether the image signal input into the control means is an internal image signal or an external image signal.

That is, when the stencil is to be made on the basis of an image signal read out from an original (this will be referred to as "a scanner input mode" or "an internal input mode", hereinbelow), the selector means is operated to make active the first stencil making position control means and the first stencil making position control means controls the stencil making position, and when the stencil is to be made on the basis of an image signal input from an external device such as a personal computer (this will be referred to as "an external input mode", hereinbelow), the selector means is operated to make active the second stencil making position control means and the second stencil making position control means controls the stencil making position. Accordingly, the stencil can be correctly made and satisfactory prints can be obtained without confusion.

It is preferred that the control means is further provided with a first display means which displays information on the stencil making position set by the first stencil making position control means, a second display means which displays information on the stencil making position set by the second stencil making position control means, a first operational means for inputting information for controlling the first stencil making position control means in controlling the stencil making position, a second operational means for inputting information for controlling the second stencil making position control means in controlling the stencil making position, and a switching means which makes active the first display means and the first operational means when the selector means makes active the first stencil making position control means, and makes active the second display means and the second operational means when the selector means makes active the second stencil making position control means.

That is, when the first stencil making position control means operates, the information on the stencil making position set by the first stencil making position control means is displayed by the first display means and information for controlling the first stencil making position control means in controlling the stencil making position can be input only through the first operational means. Similarly, when the second stencil making position control means operates, the information on the stencil making position set by the second stencil making position control means is displayed by the second display means and information for controlling the second stencil making position control means in controlling the stencil making position can be input only through the second operational means. Accordingly, the operator can clearly know which of the internal input mode and the external input mode the stencil printer is operating.

Though it is preferred that the first and second display means and the first and second operational means are all provided, a part of them may be omitted. For example, the first and second display means may be omitted so that the stencil making position controlled by the first or second stencil making position control means can be changed, though how the stencil making position is changed is not displayed. Further, the first display means and the first operational means may be omitted. In this case, the stencil making position for the internal input mode is fixed whereas the stencil making position for the external input mode is variable.

It is preferred that the control means be further provided with a first operational information holding means which holds the information for controlling the first stencil making position control means in controlling the stencil making position until different information is input and/or a second operational information holding means which holds the information for controlling the second stencil making position control means in controlling the stencil making position until different information is input.

That is, the stencil making position set last can be held until otherwise set for each input mode. Accordingly, handling of the stencil printer is further facilitated and mistake in making a stencil can be more suppressed. Only one of the first and second operational information holding means may be provided taking into account the degree of necessity.

The first and second display means may be formed by a single display device. In this case, the switching means causes the display device to display a frame corresponding to the first display means when the selector means makes active the first stencil making position control means and to display a frame corresponding to the second display means when the selector means makes active the second stencil making position control means. Further, in this case, the first and second operational means may be formed by a single input interface which functions as the first operational means when the frame corresponding to the first display means is displayed by the single display device and functions as the second operational means when the frame corresponding to the second display means is displayed by the single display device.

With this arrangement, the first and second display means can be formed by a single display panel and the first and second operational means can be formed by a single control panel, whereby the stencil printer can be simple in hardware. The switching means may be either manually operated or automatically operated according to the input mode.

In accordance with a second aspect of the present invention, there is provided an information storage medium storing therein software for controlling a stencil printer comprising a stencil making means which imagewise perforates a stencil material according to an image signal input thereinto and makes a stencil, an image read-out means which reads an image on an original and obtains an internal image signal representing the image on the original, a data selector means which selectively inputs into the stencil making means an internal image signal output from the image read-out means or an external image signal input into the stencil printer along a path different from the internal image signal, a stencil making position control means which adjusts the position of the stencil on the stencil material made by the stencil making means, a printing means which makes prints by the use of the stencil, a display means which displays information on the stencil making position adjusted by the stencil making position control means, an operational means for inputting information for controlling the stencil making position control means in adjusting the stencil making position, and a control means which controls the stencil making means and the stencil making position control means, said software representing procedure of control which is to be executed by the control means and characterized in that the control means switches the stencil making position control means between a first mode in which it functions as a first stencil making position control means adapted to control of the stencil making position when a stencil is to be made on the basis of an internal image signal optically read out from an original, and a second mode in which it functions as a second stencil making position control means adapted to control of the stencil making position when a stencil is to be made on the basis of an external image signal input through a path different from the path along which the internal image signal is input, and switches the display means between a first mode in which it functions as a first display means which displays information on the stencil making position set by the first stencil making position control means and a second mode in which it functions as a second display means which displays information on the stencil making position set by the second stencil making position control means.

That is, in a stencil printer in which its hardware including the stencil making means, the stencil making position control means, the printing means, the display means, the operational means and the like is controlled by a control means such as a CPU, the second stencil making position control means, the second display means, the second operational means and the like are incorporated as software by simply changing the ROM in which the software concerning the procedure of control is stored. Thus, by simply replacing the ROM, conventional microcomputer-controlled stencil printer can be modified to a stencil printer of the present invention.

The information storage medium in accordance with the second aspect of the present invention can be manufactured, used, copied and installed in a control means of another stencil printer.

DESCRIPTION OF THE PREFERRED EMBODIMENT

Figure 1:
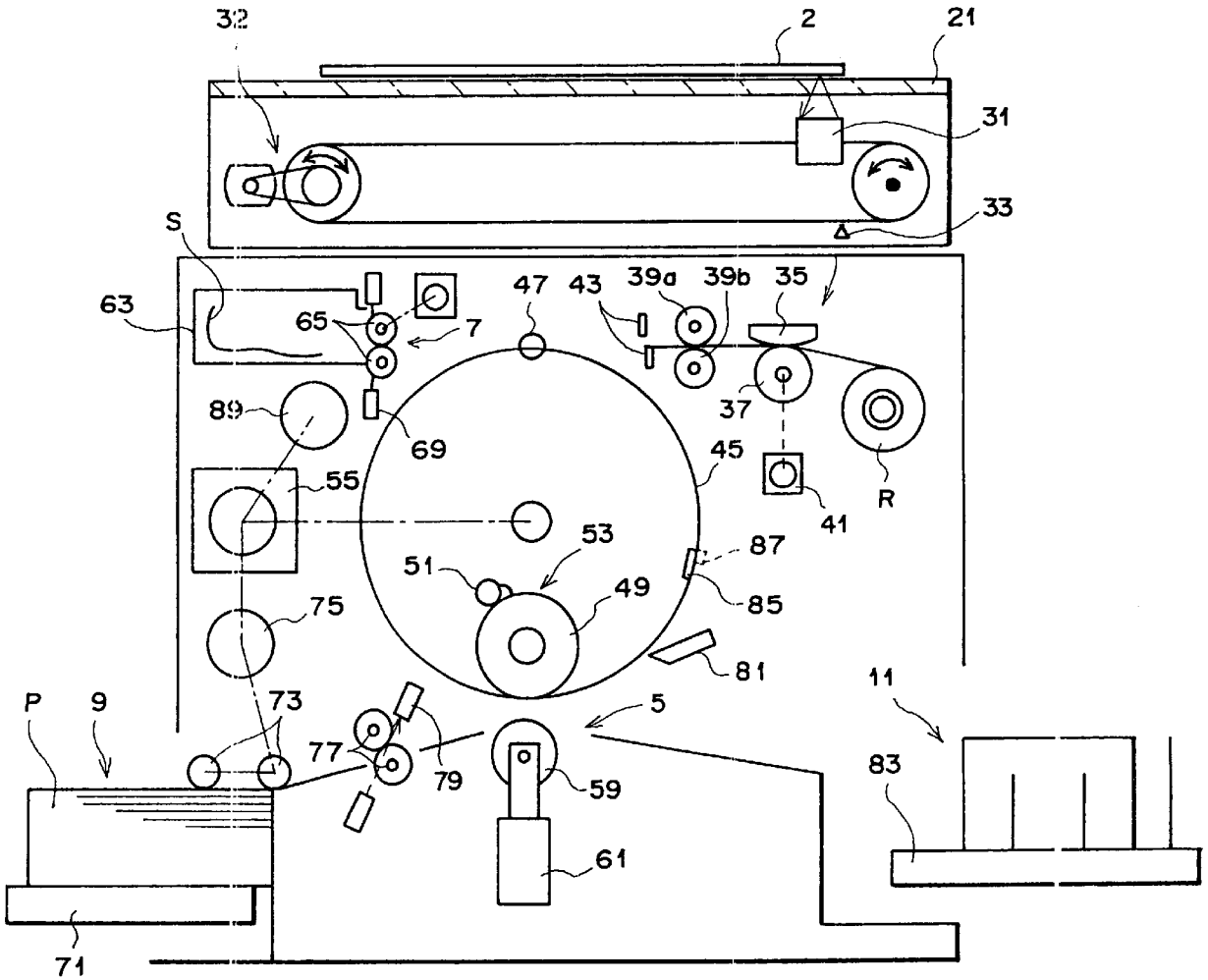
FIG. 1 is schematic view showing the mechanical structure of a stencil printer in accordance with an embodiment of the present invention.
Figure 2:
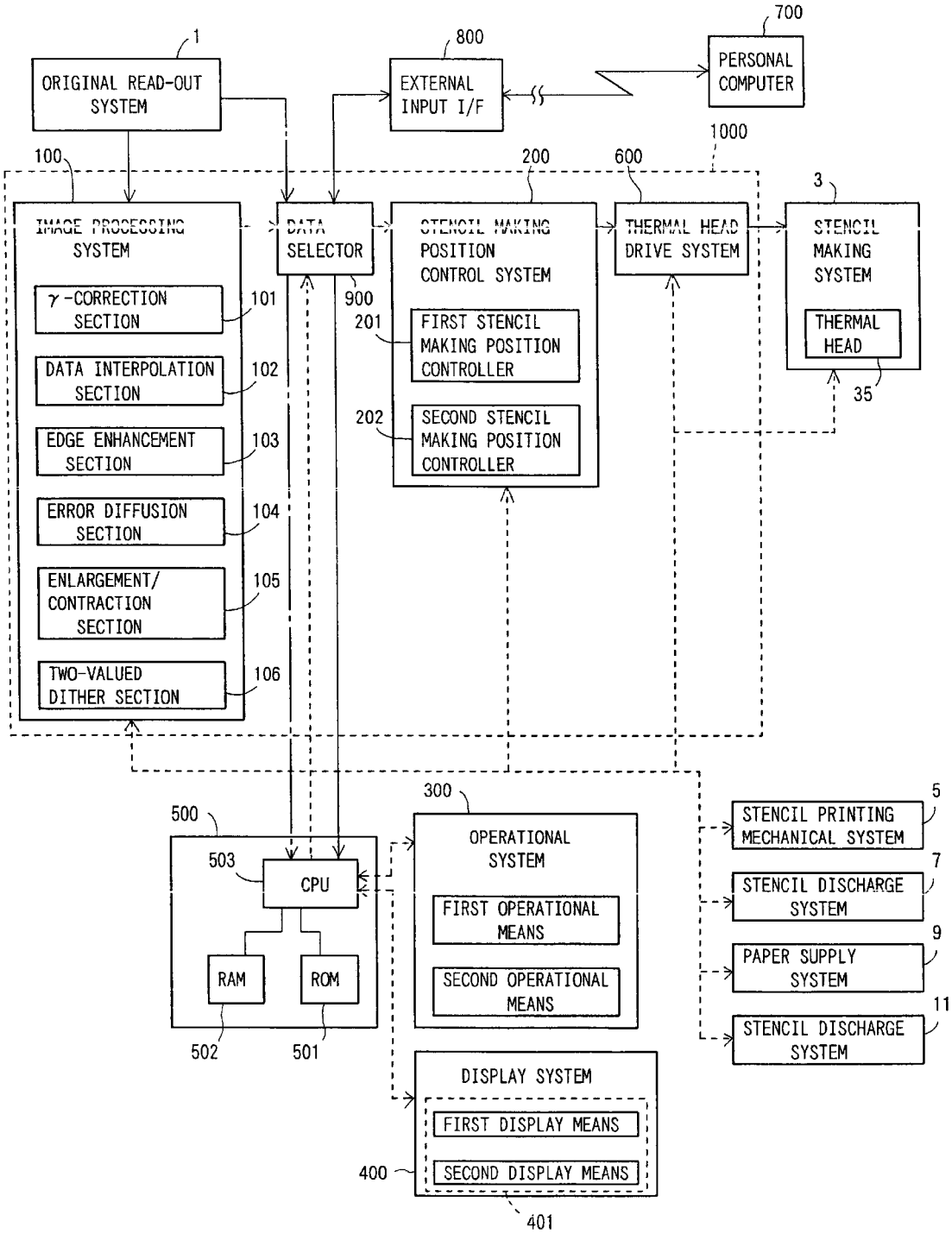
FIG. 2 is a block diagram of the control circuit of the stencil printer.

In FIGS. 1 and 2, a stencil printer in accordance with an embodiment of the present invention can operate in both a scanner input mode and an external input mode. In the scanner input mode, the stencil printer makes a stencil on the basis of an (internal) image signal representing an image read out from an original 2, and in the external input mode, the stencil printer makes a stencil on the basis of an (external) image signal (or image data) input from an external apparatus such as a personal computer. The stencil printer comprises an original read-out system 1, a stencil making system 3, a stencil printing mechanical system 5, a stencil discharge system 7, a paper supply system 9, a paper discharge system 11, an image processing system 100, a stencil making position control system 200 including first and second stencil making position controllers 201 and 202, a thermal head drive system 600, an operational system 300, a display system 400, and a control system 500 which controls the systems.

The original read-out system 1 comprises an original set table 21 which is of, for instance, a reinforced glass plate and on which the original 2 is set, an image sensor 31 which reads out the image on the original 2 and generates an image signal (an internal image signal) representing the image on the original 2, an image sensor drive motor mechanism 32 which causes the image sensor 31 to mechanically scan the original 2, and a reference position sensor 33 which detects the position of the image sensor 31. In the original read-out system 1, a method in which image data read out by the image sensor 31 is stored in a memory as a log of image data forming an image is not employed but a method in which A/D conversion and/or data processing are carried out in time series on input image data and the processed image data is transferred to the thermal head 35 is employed. The latter method is advantageous in that perforation of the stencil material can be effected as soon as the image data of the original 2 is read out substantially without time lug.

The stencil making system 3 comprises a thermal head 35 which perforates a stencil material R in a pattern representing the image of the original 2, a platen roller 37, a pair of conveyor rollers 39*a* and 39*b*, a stepping motor 41 which drives the platen roller 37 and the conveyor rollers 39*a* and 39*b*, a stencil material cutter 43. In the stencil making system 3, the stencil material R is unrolled from a roll of the stencil material roll R and the thermal head 35 perforates the stencil material R on the basis of the image signal representing the image on the original 2 with the stencil material R conveyed in a sub-scanning direction. The platen roller 37 presses the stencil material R against the thermal head 35. After the perforation, the stencil material R is fed out by the conveyor rollers 39*a* and 39*b* and cut in a length conforming to the size of the printing papers P by the cutter 43, whereby a stencil S is made.

The stencil printing mechanical system 5 comprising a printing drum 45 having an ink-permeable peripheral wall and is rotated about its longitudinal axis, a stencil clamp 47 which is provided on the outer peripheral surface of the printing drum 45 and clamps the leading end of the stencil S, an ink supply system 53 provided inside the printing drum 45 and comprising a squeegee roller 94 and a doctor roller 51, a main motor 55 which rotates the printing drum 45 in a predetermined direction, a press roller 59 which presses a printing paper P against the printing drum 45, and a press control system 61 which controls up-and-down movement of the press roller 59. A magnet 85 is fixed to the printing drum 45 on one end thereof, and a stencil winding start position sensor 87 is disposed near the printing drum 45 to sense the magnetism of the magnet 85 and detect that the printing drum 45 is rotated to a stencil winding start position. Further, the main motor 55 is provided with a rotary encoder 89 and the angular position of the printing drum 45 as measured from the stencil winding start position can be known on the basis of the output of the stencil winding start position sensor 87.

The stencil discharge system 7 comprises a pair of stencil discharge rollers 65 which removes the stencil S from the printing drum 45 and conveys it into a discharge stencil box 63 after printing and a transmission type discharged-stencil sensor 69 which detects the trailing end of the stencil S at the discharge rollers 65.

The paper supply system 9 comprises a paper supply table 71 which is moved up and down by a lift mechanism (not shown) and on which a stack of printing papers P is placed, pickup rollers 73 which take out the printing papers P on the paper supply table 71 one by one, a paper supply clutch 75 transmits and cuts the driving force from the main motor 55 to and from the pickup rollers 73, a pair of paper conveyor rollers 77 which feed the printing paper P between the printing drum 45 and the press roller 59 in synchronization with rotation of the printing drum 45, and a transmission type paper sensor 79 which detects whether there is a printing paper P at the paper conveyor rollers 77.

The paper discharge system 11 comprises a separator 81 which separates the printed paper P from the printing drum 45 and a paper discharge table 83 on which printed papers P are stacked. The separator 81 has a nozzle-like tip and blows air from the tip to facilitate separation of the printed paper P from the printing drum 45.

The control system 500 comprises a control circuit 503 which includes microcomputer CPU and controls the systems according to a control program stored in a ROM 501 in a read-only mode, and a RAM 502 which forms a first operational information holding means which holds first operational information and a second operational information holding means which holds second operational information. The control system 500 controls in synchronization with each other the original read-out system 1, the stencil making system 3, the stencil printing mechanical system 5, the stencil discharge system 7, the paper supply system 9, the paper discharge system 11, the image processing system 100, a data selector 900, the stencil making position control system 200, the thermal head drive system 600 and the display system 400.

The operational system 300 comprises a control panel 301 (FIG. 11) provided with a group of keys 302 including, in addition to various known keys such as a stencil making start key, a printing start key, a printing mode setting key, a ten-key pad for inputting the number of copies or the like, a reset key, an emergency stop key and the like, an input mode switching key for switching between the scanner input mode, where the stencil S is to be made on the basis of an image signal input from the image sensor 31 and the stencil making position is adjusted by the first stencil making position controller 201 and the external input mode, where the stencil S is to be made on the basis of an external image signal and the stencil making position is adjusted by the second stencil making position controller 202. That is, in this particular embodiment, the operational system 300 doubles a first operational means for inputting information for stencil making position adjustment by the first stencil making position controller 201 and a second operational means for inputting information for stencil making position adjustment by the second stencil making position controller 202.

Figure 11:
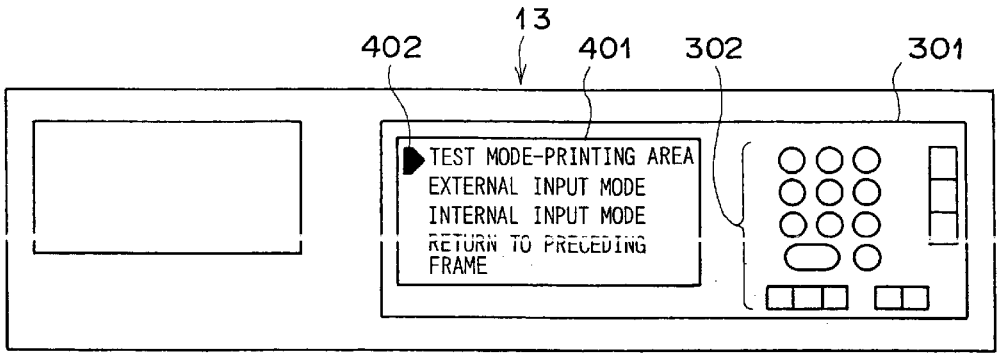
FIG. 11 is a schematic view showing the interface panel.

The display system 400 comprises a display panel 401 like a liquid crystal panel for displaying information on the action of the stencil printer, and a character generator and a drive circuit (which are not shown) for displaying the information on the display panel 401 (FIG. 11). The display system 400 functions as a first display means for displaying information for stencil making position adjustment by the first stencil making position controller 201 when the scanner input mode is selected by the input mode switching key of the operational system 300 and functions as a second display means for displaying information for stencil making position adjustment by the second stencil making position controller 202 when the external input mode is selected by the input mode switching key of the operational system 300.

As shown in FIG. 11, the control panel 301 and the display panel 401 are provided side by side on an interface panel 13 provided on the top of the stencil printer, and the operator operates the aforesaid keys 302 referring to information displayed on the display panel 401 such as shown in FIGS. 4 to 7 to be described later.

The image processing system 100, the data selector 900, the stencil making position control system 200 and the thermal head drive system 600 are provided in a unit (in one circuit board) as an processing circuit system 1000.

The image processing system 100 digitizes an electric image signal representing an image read out from the original 2 by the original read-out system 1 and carries out a normal image processing on the digitized image signal, thereby obtaining an image signal on the basis of which the thermal head 35 perforates the stencil material R. More specifically, the image processing system 100 comprises a γ-correction section 101 which carries out a γ-correction of tone properties or the like on an image signal transferred from the original read-out system 1, a data interpolation section 102 which interpolates image data between pixels according to a predetermined rule, e.g., priority is given to black, an edge enhancement section 103 which enhances edges on the basis of data, an error diffusion section 104, an enlargement/contraction section 105 which enlarges and contracts the image on the basis of data, and an adapted two-valued dither section 106 which carries out a so-called tow-valued dither processing to enhance the tone reproduction of the image.

The data selector 900 selects, under the control of the control system 500, the processed internal image signal (an image signal input from the original read-out system 1 and processed by the image processing system 100) and transfers it to the stencil making position control system 200 when the scanner input mode is selected, and selects an external image signal input into the stencil printer from an external personal computer 700 or the like through an external input I/F 800 and transfers it to the stencil making position control system 200 when the external input mode is selected.

The stencil making position control system 200 comprises a first stencil making position controller 201 into which an internal image signal is input when the scanner input mode is selected and a second stencil making position controller 202 into which an external image signal is input when the external input mode is selected. The first stencil making position controller 201 adjusts, on the basis of data, the position of the stencil to be made on the basis of the input internal image signal in both the vertical direction and the transverse direction. The second stencil making position controller 202 adjusts, on the basis of data, the position of the stencil to be made on the basis of the external internal image signal in both the vertical direction and the transverse direction.

The first and second stencil making position controllers 201 and 202 carry out the adjustment under the control of the control system 500 on the basis of the command of the operator input through the operational system 300. It is needless to say, when the stencil making position is kept in a position conforming to the input image signal, neither the first and second stencil making position controllers 201 and 202 operates. Linked with the adjustment of the stencil making position on the basis of data by the stencil making position control system 200, information on how the adjustment is carried out is displayed by the display system 400.

The thermal head drive system 600 generates a thermal head drive waveform on the basis of the image signal input from the stencil making position control system 200 and transfers the thermal head drive waveform to the stencil making system 3. Then the thermal head 35 is driven by the thermal head drive waveform.

Operation of the stencil printer of this embodiment will be described with reference to the flow chart shown in FIG. 3 mainly on the stencil making process and the printing process.

Figure 4:
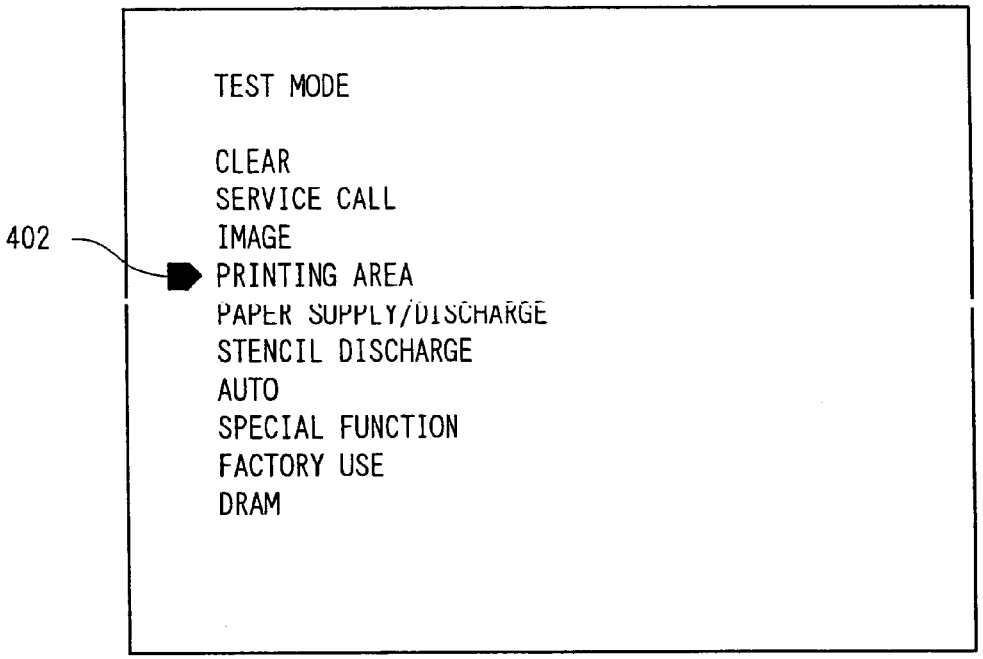
FIG. 4 is a view showing an example of the "test mode frame" displayed on the display panel.
Figure 5:
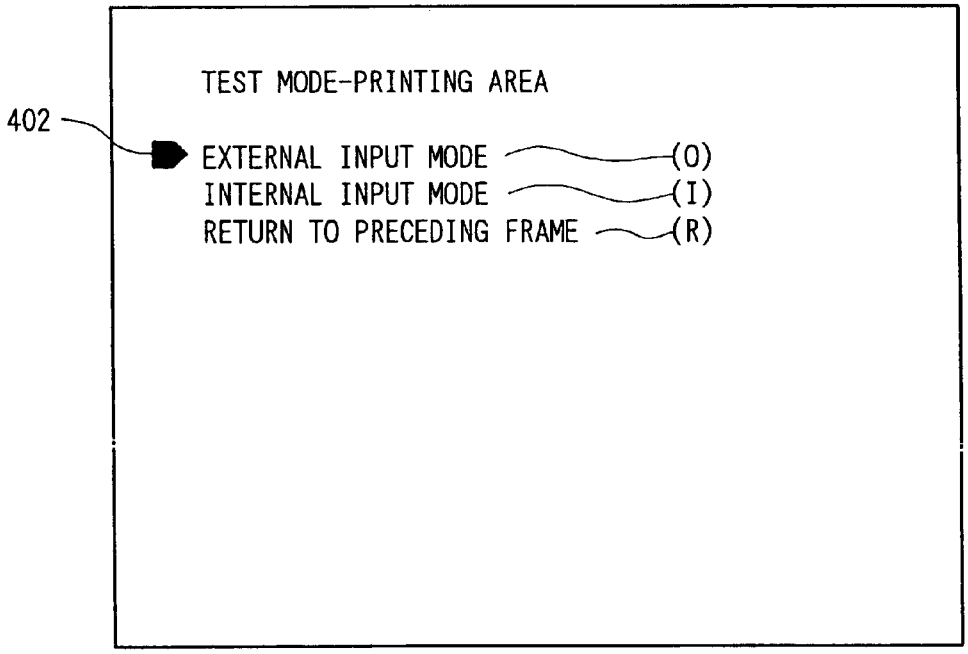
FIG. 5 is a view showing an example of the "printing area setting frame" displayed on the display panel.

When the stencil making process or the printing process is initiated, a "test mode frame" shown in FIG. 4 is displayed on the display panel 401 of the display system 400. (step S1) When the operator selects "printing area" from the items displayed on the display panel 401, a "printing area setting frame" shown in FIG. 5 is displayed on the display panel 401. (steps S2 and S3) For example, the "printing area" can be selected by operating a cursor moving key (not shown) of the operational system 300 to move a cursor 402 to the "printing area" and depress a selector key (not shown).

As shown in FIG. 5, in the "printing area setting frame", three alternatives, "external input mode" (O), "internal input mode" (I) and "return to preceding frame" (R), are displayed under the title "test mode—printing area". By moving the cursor 402 to one of the alternatives and depressing the selector key, one of the alternatives is selected by the operator. (step S4)

When the "return to preceding frame" (R) is selected in step S4, the frame on the display panel 401 returns to the test mode frame shown in FIG. 4.

Figure 6:
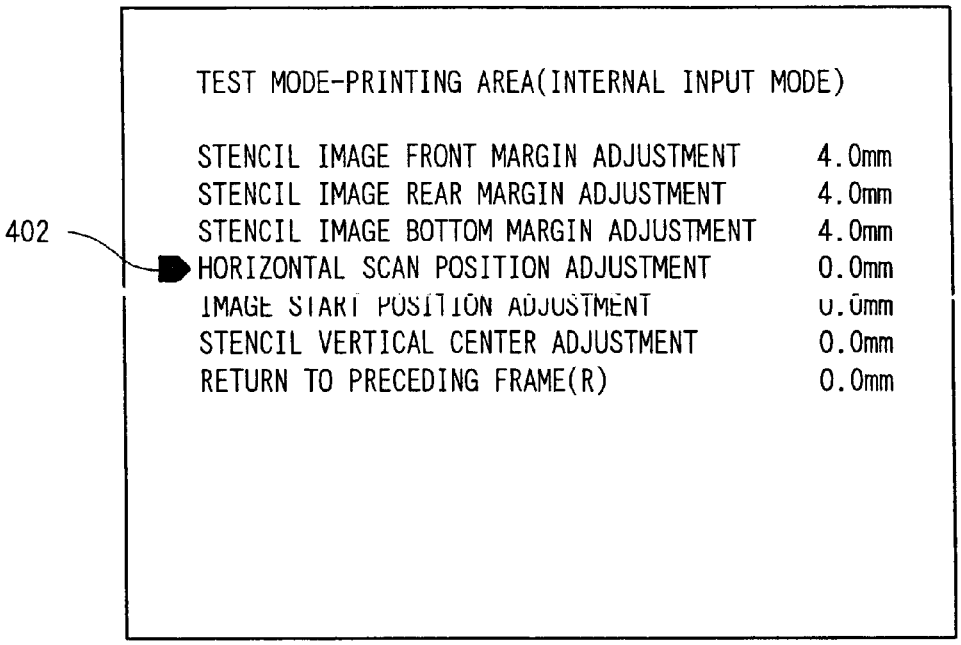
FIG. 6 is a view showing an example of the "test mode-printing area (internal input mode)" displayed on the display panel.

When the "internal input mode" (I) is selected in step S4, various adjustment variables for use in adjustment of the stencil making position for the internal image signal are displayed on the display panel 401 under the title "test mode—printing area (internal input mode)" as shown in FIG. 6. (step S5) At this time, the display system functions as the first display means.

Then the operator inputs desired values of the adjustment variables displayed in the frame by operating the keys of the operational system 300. The stencil making position for the internal input mode is adjusted on the basis of the values of the adjustment variables. (step S6) At this time, the operational system 300 functions as the first operational means, and the first stencil making position controller 201 in the stencil making position control system 200 operates.

Figure 7:
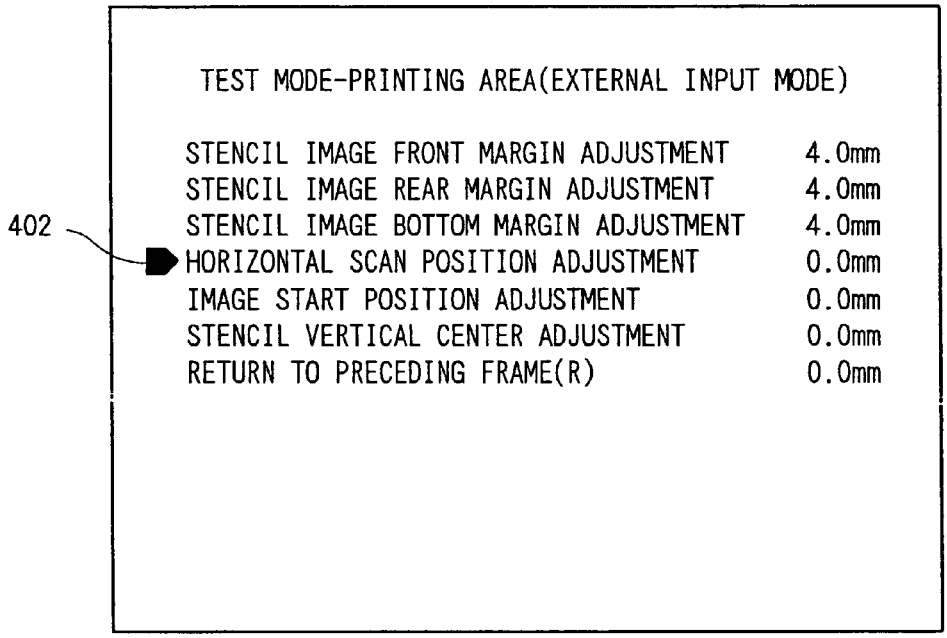
FIG. 7 is a view showing an example of the "test mode-printing area (external input mode)" displayed on the display panel.

When the external input mode" (O) is selected in step S4, various alternatives for use in adjustment of the stencil making position for the external image signal are displayed on the display panel 401 under the title "test mode—printing area (external input mode)" as shown in FIG. 7. (step S7) At this time, the display system functions as the second display means.

Then the operator inputs desired values of the adjustment variables displayed in the frame by operating the keys of the operational system 300. The stencil making position for the external input mode is adjusted on the basis of the values of the adjustment variables. (step S8) At this time, the operational system 300 functions as the second operational means, and the second stencil making position controller 202 in the stencil making position control system 200 operates.

The control system 500 controls switching the first and display means of the display system 400, switching the first and second operational means of the operation system 300 and switching the first and second stencil making position controllers 201 and 202 of the stencil making position control system 200.

Each of the internal image signal and the external image signal which are adjusted with the stencil making position on the basis of data is transferred to the thermal head drive system 600. The thermal head drive system 600 generates a thermal head drive waveform on the basis of the image signal input from the stencil making position control system 200 and transfers the thermal head drive waveform to the stencil making system 3. Then the thermal head 35 is driven according to the thermal head drive waveform and makes a stencil. (step S9) Then a so-called first print is made by the use of the stencil. (step S10) Since the stencil thus made has been adjusted with its position in the manner described above, the print should be printed in a desired position on the printing paper.

However, when the value of an adjustment variable input by the operator is not proper, the position of the stencil actually made can be deviated from the desired position. Especially when the stencil is made for the first time, it is difficult to estimate how much the position of the stencil actually made is deviated from the desired position. Accordingly, a stencil is once made and a first print is made by the use of the stencil. According to the first print, it is determined whether the stencil making position is proper. When the stencil making position is not proper, the operator recalls the test mode frame by operating the operational system 300 and steps S1 to S10 are repeated, whereas when it is determined that the stencil making position is proper, full-scale printing is effected until a desired number of prints are made. (steps S11 to S13)

The stencil making position adjustment process for the internal input mode to be executed in steps S5 and S6 and the stencil making position adjustment process for the external input mode to be executed in steps S7 and S8 will be described in more detail, hereinbelow.

Figure 8:
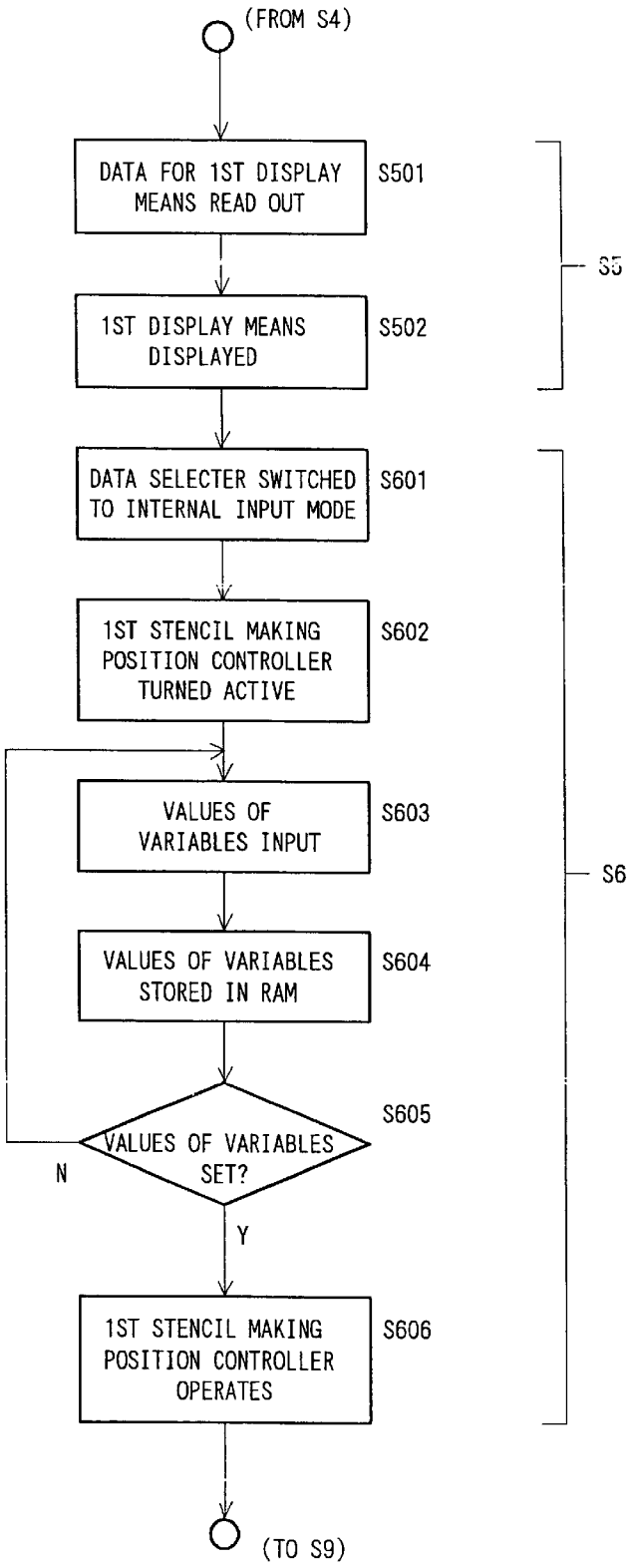
FIG. 8 is a flow chart for illustrating in more detail the stencil making position adjustment process for the internal input mode to be executed in steps S5 and S6.

As shown in the flow chart shown in FIG. 8, in the stencil making position adjustment process for the internal input mode to be executed in steps S5 and S6, when the "internal input mode" (I) is selected, the control system 500 reads out from the ROM 501 data necessary to display a frame corresponding to the first display means on the display panel 401 of the display system 400. (step S501) Then the control system 500 causes the display system 400 to display the "test mode—printing area (internal input mode) frame" shown in FIG. 6 on the basis of the data read out from the ROM 501. (step S502)

Then the control system 500 switches the data selector 900 to the internal input mode so that the internal image signal can be input. (step S601) At the same time, the control system 500 turns active the first stencil making position controller 201 of the stencil making position control system 200. (step S602)

When the frame for the internal input mode shown in FIG. 6 is displayed on the display panel 401, the operator inputs desired values of the adjustment variables through the operational panel 300. (step S603) The values input by the operator are once stored in the RAM 502. (step S604) That is, the values of the adjustment variables stored in the RAM 502 are held by the RAM 502 at least until other values of the adjustment variables for the internal input mode are thereafter input. When new values of the adjustment variables are input, the values to be stored in the RAM 502 are updated by overwriting the new values. For example, the adjustment variables may include, as shown in FIG. 6, "Stencil Image Front Margin Adjustment", "Stencil Image Rear Margin Adjustment", "Stencil Image Bottom Margin Adjustment", "Horizontal Scan Position Adjustment", "Image Start Position Adjustment", "Stencil Vertical Center Adjustment", and the like.

After inputting the values of all the necessary adjustment variables, the operator inputs a signal representing that input of the values is finished through the operational system 300, and the first stencil making position controller 201 adjusts the stencil making position on the basis of the input values of the adjustment variables under the control of the control system 500. (steps S605 and S606)

Figure 9:
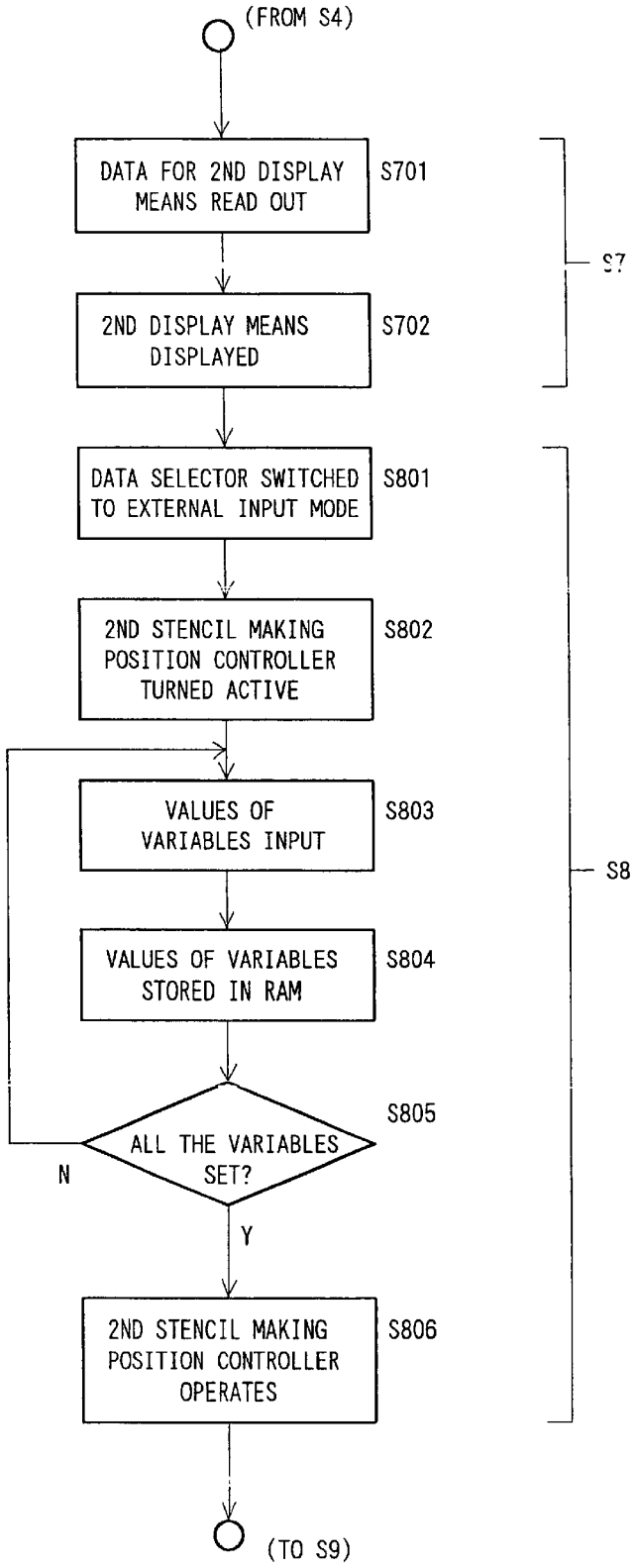
FIG. 9 is a flow chart for illustrating in more detail the stencil making position adjustment process for the external input mode to be executed in steps S7 and S8.

As shown in the flow chart shown in FIG. 9, in the stencil making position adjustment process for the external input mode to be executed in steps S7 and S8, when the "external input mode" (O) is selected, the control system 500 reads out from the ROM 501 data necessary to display a frame corresponding to the second display means on the display panel 401 of the display system 400. (step S701) Then the control system 500 causes the display system 400 to display the "test mode—printing area (external input mode) frame" shown in FIG. 7 on the basis of the data read out from the ROM 501. (step S702)

Then the control system 500 switches the data selector 900 to the external input mode so that the external image signal can be input. (step S801) At the same time, the control system 500 turns active the second stencil making position controller 202 of the stencil making position control system 200. (step S802)

When the frame for the external input mode shown in FIG. 7 is displayed on the display panel 401, the operator inputs desired values of the adjustment variables through the operational panel 300. (step S803) The values input by the operator are once stored in the RAM 502. (step S804) That is, the values of the adjustment variables stored in the RAM 502 are held by the RAM 502 at least until other values of the adjustment variables for the internal input mode are thereafter input. When new values of the adjustment variables are input, the values to be stored in the RAM 502 are updated by overwriting the new values. For example, the adjustment variables may include, as shown in FIG. 7, "Stencil Image Front Margin Adjustment", "Stencil Image Rear Margin Adjustment", "Stencil Image Bottom Margin Adjustment", "Horizontal Scan Position Adjustment", "Image Start Position Adjustment", "Stencil Vertical Center Adjustment", and the like.

The "Horizontal Scan Position Adjustment" is an adjustment variable concerning the lateral position of the image formed on the stencil material, that is, as the value of this variable is increased, the printing area is displaced leftward.

The "Stencil Vertical Center Adjustment" is an adjustment variable concerning the vertical position of the image formed on the stencil material, that is, as the value of this variable is increased, the printing area is displaced downward.

The "Stencil Image Front Margin Adjustment" and the "Stencil Image Rear Margin Adjustment" are variables concerning to the amounts of image to be cut on the left and right sides of the stencil to be made (normally 4.0 mm). The "Stencil Image Bottom Margin Adjustment" is a variable concerning to the amount of image to be cut on the trailing end of the stencil to be made (normally 4.0 mm).

Figure 12:
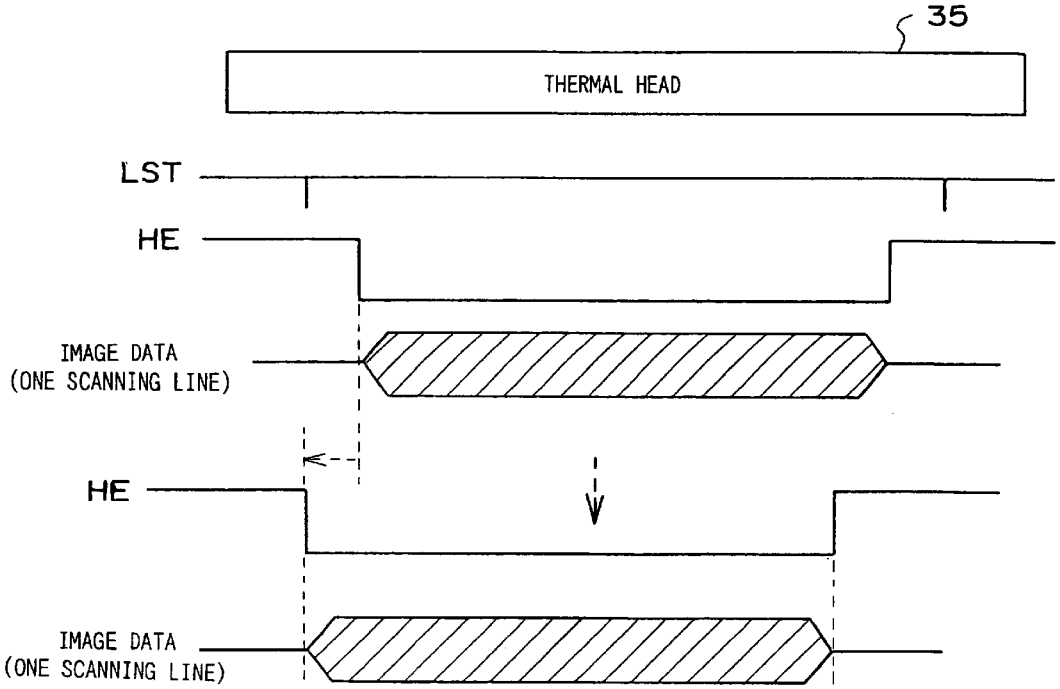
FIG. 12 is a view for illustrating a method of shifting the stencil making position on the basis of data.

The stencil making position, that is, the position of the image on the stencil material, can be adjusted on the basis of data, for instance, in the following manner. That is, in the case of the "Horizontal Scan Position Adjustment", the stencil making position can be shifted by shifting HE (FIG. 12) which controls the timing at which the image signal begins to be transferred to the thermal head 35 of the stencil making section 3 from the thermal head drive system 600, thereby shifting the position of the thermal head 35 relative to the stencil material at the time a given part of the image signal is input into the thermal head 35. However, the stencil making position may be adjusted by any method without limiting to the method described above.

After inputting the values of all the necessary adjustment variables, the operator inputs a signal representing that input of the values is finished through the operational system 300, and the second stencil making position controller 202 adjusts the stencil making position on the basis of the input values of the adjustment variables under the control of the control system 500. (steps S805 and S806)

Thus the first and second stencil making position controllers 201 and 202 are selectively used according to the input mode, i.e., which is selected, the internal or scanner input mode or the external input mode. Since the first display means is used when the first stencil making position controller 201 for the internal input mode is used and the second display means is used when the second stencil making position controller 202 for the external input mode is used, the operator can be prevented from confusing the input modes and a wrong operation of the printer in making a stencil or in printing due to the confusion of the input modes can be avoided. For example, an accident that a stencil which is to be made on the basis of an internal image signal is made in a position which has been set for the external input mode can be avoided.

Further, since the adjustment variables input through the first and second operational means are held in the RAM 502 mode by mode, even if printing is made without adjusting the stencil making position, the stencil making position cannot be greatly shifted from the optimal position since the stencil making position which has been set is the stencil making position for the same input mode.

Further, as can be understood from the description above, the stencil making position for the external input mode can be adjusted without necessity for the operator to move back and forth between the stencil printer and the personal computer.

Figure 10:
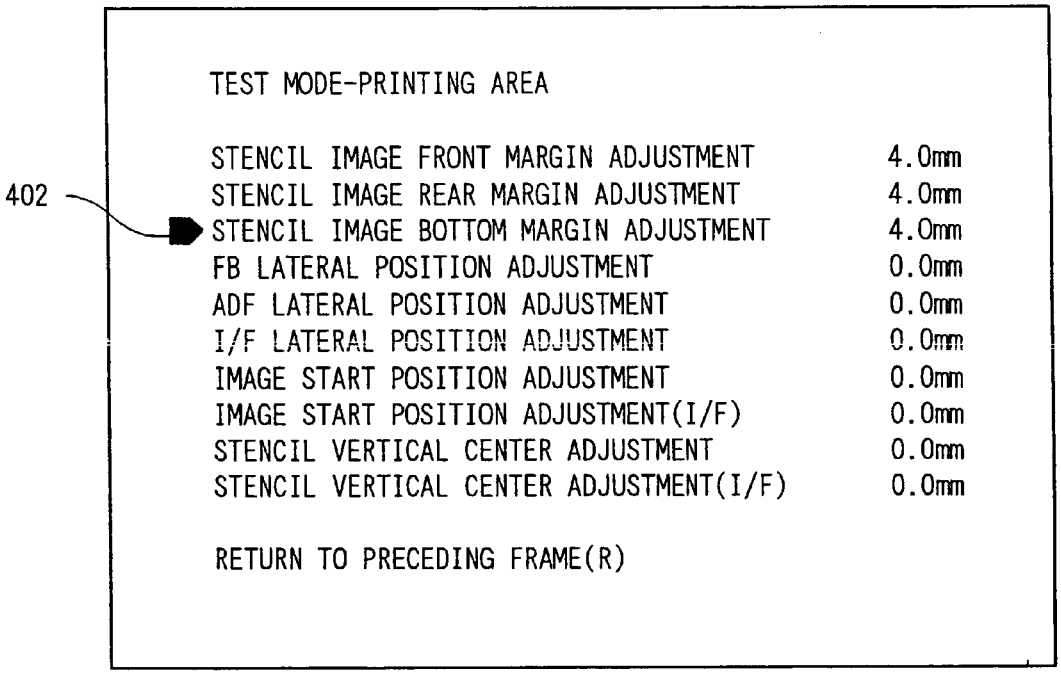
FIG. 10 is a view showing a modification of the "test mode—printing area" frame.

Though, in the embodiment described above, the frame as the first display means and the frame as the second display means are displayed on one display panel 401 and switched according to the input mode, the frames as the first and second display means may be integrated as shown in FIG. 10.

Otherwise, it is possible to display the frames as the first and second display means on separate display panels.

Further, in the embodiment described above, one operational system 300 (control panel) doubles as the first and second operational means, a pair of separate control panels may be provided one as the first operational means and the other as the second operational means.

Further, though, in the embodiment described above, the external input mode or the internal input mode is manually selected by moving the cursor 402 on the "printing area setting frame" shown in FIG. 5, it is possible to cause the control system 500 to automatically set the printing mode to the external input mode or the internal input mode according to the source of the image signal, that is, the original read-out system 1 or the external input I/F 800. In this case, the original read-out system 1 and the external input I/F 800 are connected to the CPU 503 of the control system 500 as shown by the chained line in FIG. 2, and the CPU 503 detects which of the image signals from the original read-out system 1 and the external input I/F 800 is active. Then the control system 500 controls the data selector 900 according to the source of the image signal.

Figure 3:
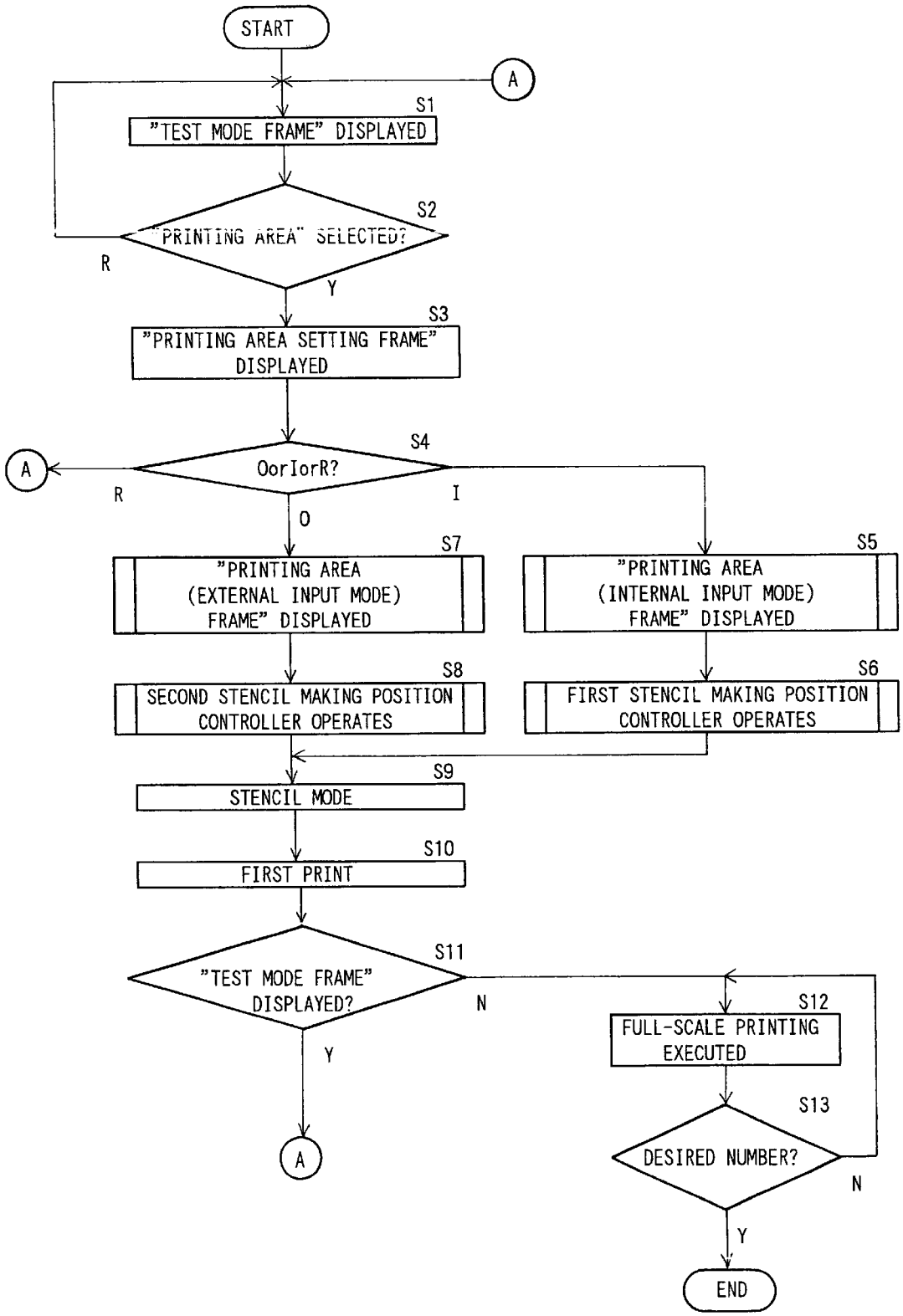
FIG. 3 is a flow chart for illustrating the operation of the stencil printer mainly on the stencil making process and the printing process.

Conventional stencil printers whose hardware includes the stencil making means, the stencil making position control means, the printing means, the display means and the operational means and is controlled by a control means such as a CPU can be modified to a stencil printer in accordance with the present invention by simply incorporating a ROM storing therein software for carrying the procedure shown in FIGS. 3, 8 and/or 9.

In addition, all of the contents of Japanese Patent Application No. 11(1999)-374363 are incorporated into this specification by reference.

What is claimed is:

1. A stencil printer comprising a stencil making means which makes a stencil by imagewise perforating a stencil material in a controlled position thereon on the basis of an image signal, a printing means which makes prints by the use of the stencil made by the stencil making means and a control means which controls the stencil making means and the printing means, wherein the improvement comprises that the control means is provided with a first stencil making position control means adapted to control of the stencil making position when a stencil is to be made on the basis of an internal image signal optically read out from an original, a second stencil making position control means adapted to control of the stencil making position when a stencil is to be made on the basis of an external image signal input through a path different from the path along which the internal image signal is input, and a selector means which selectively makes active one of he first and second stencil making position control means.

2. A stencil printer as defined in claim 1 in which the selector means is manually operated to make active one of the first and second stencil making position control means.

3. A stencil printer as defined in claim 1 in which the selector means is automatically operated to make active one of the first and second stencil making position control means according to whether the image signal input into the control means is an internal image signal or an external image signal.

4. A stencil printer as defined in claim 1 in which the control means is further provided with a first display means which displays information on the stencil making position set by the first stencil making position control means, a second display means which displays information on the stencil making position set by the second stencil making position control means, a first operational means for inputting information for controlling the first stencil making position control means in controlling the stencil making position, a second operational means for inputting information for controlling the second stencil making position control means in controlling the stencil making position, and a switching means which makes active the first display means and the first operational means when the selector means makes active the first stencil making position control means, and makes active the second display means and the second operational means when the selector means makes active the second stencil making position control means.

5. A stencil printer as defined in claim 4 in which the control means is further provided with at least one of a first operational information holding means which holds the information for controlling the first stencil making position control means in controlling the stencil making position until different information is input and a second operational information holding means which holds the information for controlling the second stencil making position control means in controlling the stencil making position until different information is input.

6. A stencil printer as defined in claim 4 in which the control means comprises a single display device and the switching means causes the display device to display a frame corresponding to the first display means when the selector means makes active the first stencil making position control means and to display a frame corresponding to the second display means when the selector means makes active the second stencil making position control means.

7. A stencil printer as defined in claim 6 in which the control means comprises a single input interface which functions as the first operational means when the frame corresponding to the first display means is displayed by the single display device and functions as the second operational means when the frame corresponding to the second display means is displayed by the single display device.

* * * * *